US006632098B1

(12) United States Patent
Wong et al.

(10) Patent No.: US 6,632,098 B1
(45) Date of Patent: Oct. 14, 2003

(54) ADJUSTABLE ELECTRICAL PLUG

(75) Inventors: Wai Lun Wong, Hong Kong (HK); Yiu Keung Fung, Hong Kong (HK)

(73) Assignee: PI Electronics (HK) Ltd., Kowloon (HK)

( * ) Notice: Subject to any disclaimer, the term of this patent is extended or adjusted under 35 U.S.C. 154(b) by 0 days.

(21) Appl. No.: 09/544,955

(22) Filed: Apr. 7, 2000

(30) Foreign Application Priority Data

Apr. 8, 1999 (GB) ..... 9908016

(51) Int. Cl.[7] ..... H01R 13/44; H01R 13/60
(52) U.S. Cl. ..... 439/131
(58) Field of Search ..... 439/131, 172, 439/104

(56) References Cited

U.S. PATENT DOCUMENTS 4,997,381 A * 3/1991 Oh ..... 439/172
5,628,641 A * 5/1997 Hahn ..... 439/131
5,791,921 A * 8/1998 Lee ..... 439/172
6,042,400 A * 3/2000 Queffelec et al. ..... 439/131
6,059,584 A * 5/2000 Mareno ..... 439/131
6,062,880 A * 5/2000 Skuza ..... 439/131
6,190,184 B1 * 2/2001 Cimbal et al. ..... 439/131

FOREIGN PATENT DOCUMENTS

GB 2215531 * 9/1989

* cited by examiner

*Primary Examiner*—Javaid H. Nasri
(74) *Attorney, Agent, or Firm*—Burns, Doane, Swecker & Mathis, L.L.P.

(57) ABSTRACT

An electrical plug, for example an AC adaptor, has a pair of pins that may be moved between an operative position and a non-operative position in which the pins are received within slots formed in a body. When in the non-operative position the pins are completely received within the slots and a mechanism is provided for releasing the pins from the slots when it is desired to move the pins into their operative position. The pins pivot about a pivot axis located adjacent an edge of the body so that the pins pivot outwardly towards the edge into their operative position.

11 Claims, 5 Drawing Sheets

ADJUSTABLE ELECTRICAL PLUG

CROSS REFERENCE TO RELATED APPLICATION

This application claims priority to UK Application Serial No. 9908016.0 (filed Apr. 8, 1999), Attorney Docket No. AF-57629. This application is hereby incorporated herein by reference in its entirety.

This invention relates to an electrical plug, and to a mechanism therefor, and in particular to a mechanism for an electrical plug in the form of an adaptor such as an AC adaptor having foldable pins.

Figure 1:
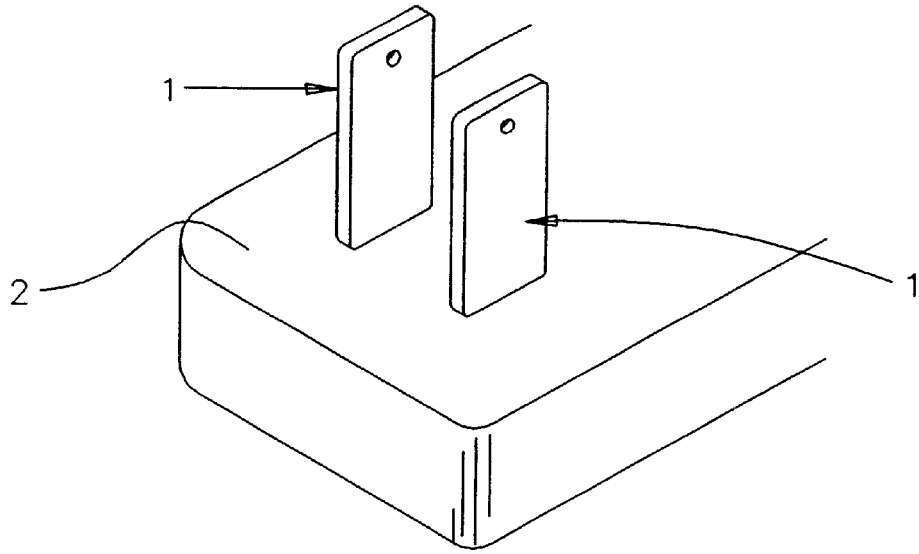
FIG.1 (PRIOR ART)

In its simplest form an electrical plug such as a conventional electrical adaptor, for example an AC adaptor for use with various forms of electrical apparatus, may have a pair of adaptor pins 1 fixed so as to extend from the adaptor body 2. Such a conventional arrangement is shown in FIG. 1. While having the advantage of simplicity this arrangement has numerous disadvantages. The most important among these drawbacks are that since the pins are fixed, the adaptor takes up unnecessary space when not in use. In addition the pins represent sharp edges that again when not in use can be disadvantageous and even potentially dangerous. This is particularly true when the adaptor pins are in the form of blades that can be quite sharp.

Figure 2:
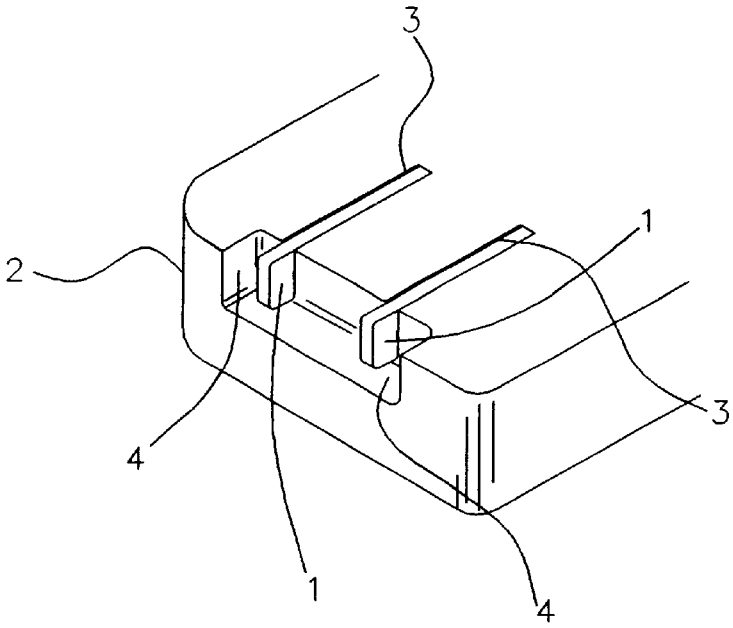
FIG.2 (PRIOR ART)

Accordingly it is known to provide an adaptor in which the adaptor pins can be folded out of the way when the adaptor is not in use. An example of such a known adaptor is shown in FIG. 2. As in FIG. 1 the adaptor is provided with a pair of pins 1 and an adaptor body 2. In this adaptor however the pins 1 may be pivoted about their ends between a vertical position for use, and a horizontal position when not in use in which the pins 1 are received within slots 3 formed in the adaptor body 2. The pins 1 are pivotally mounted such that their ends distal from the pivots are located at an edge of the adaptor body 2, and this edge is provided with recessed portions 4 about the ends of the pins 1 such that the ends of the pins 1 can be engaged by a user's fingers in order to move the pins from a horizontal non-operative position to a vertical operative position.

While the adaptor of FIG. 2 represents an improvement over the fixed pin adaptor of FIG. 1, it is not without its own disadvantages and drawbacks. Firstly, while when not in use most of the length of the pins 1 are received within the adaptor body 2 the ends of the pins 1 are still exposed (and indeed have to be to allow the pins 1 to be pivoted) and these exposed ends can still be dangerous. In addition the pivoting mechanism introduces its own drawbacks. To begin with, when assembling a conventional adaptor of the type shown in FIG. 2, screws or interlocking components must be used to hold the pins in place during assembly to prevent them being lost. Additionally providing the pivot point at the ends of the pins 1 located remote from the edge of the adaptor body 2 means that a relatively large space must be provided around the pivot mechanism to provide a large buffer safety clearance area. The recesses 4 reduce the amount of usable space within the adaptor body, and generally the design is complex and leads to a large adaptor body being needed.

According to the present invention there is provided an electrical plug comprising a body and at least two pins, said pins being movable between a first operative position in which the pins extend from the body, and a second non-operative position in which the pins are received within slots formed in the body, wherein said pins are pivotally mounted for movement between said first and second positions and wherein the pins pivot about a pivot axis located at an end of each respective pin adjacent an edge of said body whereby when said pins pivot from said second position to said first position, the ends of said pins distal from said pivot axis move towards said edge of said body, and wherein when the pins are said second position, said pins are completely received within the slots.

By means of this arrangement the pivot axis of the pins is located closer to the edge of the body than in the prior art and this allows a smaller clearance space to be used around the pins within the body. Furthermore because when the pins are in the nonoperative second position they are completely received within the slots, no sharp edges are exposed.

In a particularly preferred embodiment means are provided for releasing the pins from the second position prior to the pins being moved into the first position. Preferably this releasing means may comprise a tongue formed in a surface of the body and depression of which causes partial rotation of the pins such that the pins are caused to move to an intermediate position in which they project above the surface. This may be achieved by forming a projection on an underside of the tongue and engaging a member fixed to the pins so as to cause rotation thereof following depression of the tongue.

The member fixed to the pins may be a position locating member having three positions corresponding to the first, second and intermediate positions. Preferably, for example, the position locating member may be provided with three recesses corresponding to the three positions, and a locking pawl may be formed on the underside of the surface of the body for engagement with said recesses.

Preferably, in order to prevent the pins going beyond the first and second positions, means are provided for limiting movement of the pins. Such limiting means may comprise stop surfaces located within the body and which engage corresponding surfaces of a pivot body formed at an end of each pin.

In a particularly preferred embodiment of the invention the plug comprises two parallel pins and two corresponding parallel slots, each slot having an enlarged end for receiving an enlarged pivot body formed at one end of each pin, a position locating member being fixed to both the pivot bodies and located therebetween, and means for releasing the pins from said second position into an intermediate position prior to the pins being moved to the first position comprising a tongue formed in the adaptor body between the slots, the tongue being adapted to act upon said position locating member upon depression thereof.

Viewed from another broad aspect the present invention provides an electrical plug comprising a body and at least two pins, said pins being movable between a first operative position in which the pins extend from the body, and a second non-operative position in which the pins are received within slots formed in the body, wherein when the pins are in the second position they are completely received within the slots.

By means of this aspect of the present invention there is provided an electrical plug in which the pins may be folded away when not in use and with no part of the pins being exposed in a potentially dangerous manner.

Viewed from a still further aspect of the present invention there is provided an electrical plug comprising a body and at least two pins, the pins being movable between a first operative position in which the pins extend from the body, and a second nonoperative position in which the pins are received within slots formed in the body, wherein means are provided for releasing the pins from the second position to an intermediate position prior to moving the pins to the first position.

In this way a particuarly simple mechansim may be provided for releasing the pins from their slots so that a user does not have to use his or her fingers to extract the pins from the slots, with the risk of injury to the fingers if the pins are sharp.

The present invention is particularly suited for electrical plugs that serves as electrical adaptors, for example for laptop PCs, which must be carried around when not in use.

Viewed from another broad aspect the present invention provides a method for assembling an electrical plug of the type having at least two pins that are movable between a first operative position in which the pins extend from the plug body, and a second inoperative position in which the pins are received within slots formed in the plug body, comprising:

(a) inserting said pins through enlarged openings formed at the ends of said slots, said pins being inserted from the inner surface of a member forming the side of said plug being formed with said slots and said pins being inserted at an angle of approximately 45° to said surface, (b) rotating said pins so that they are fully received within said slots, and (c) assembling said member to the remainder of said plug, wherein said inner surface of said member is formed with at least one surface for preventing disengagement of said pins from said member during the assembly operation.

The surface for preventing disengagement of the pins may, for example, be a surface that defines an underside of the slot, or a surface that acts upon pivot bodies formed at the end of the pins.

An embodiment of the invention will now be described by way of example and with reference to the accompanying drawings, in which:

FIG. 1 is a perspective view of one form of an adaptor according to the prior art, FIG. 2 is a perspective view of another form of adaptor according to the prior art, FIGS. 3 to 6 are perspective views of an adaptor according to the embodiment of the invention showing the adaptor pins being released from their non-operative position, FIGS. 7 to 10 are sectional views through the adaptor according to an embodiment of the invention and corresponding in sequence to FIGS. 3 to 6, and FIGS. 11 to 14 show in sequence a part of an assembly operation for the adaptor of FIGS. 3 to 10.

Referring firstly to FIGS. 3 to 6 there is shown an electrical AC adaptor according to a preferred embodiment of the present invention and showing in sequence how the elongate blade-like pins 1 are moved into a first operative position from a second nonoperative position. It will be understood here that while the illustrated embodiment shows an adaptor having blade-like pins, the invention is not limited thereto and could equally be applied to an adaptor or any form of electrical plug having round pins. It will also be understood that the present invention is applicable to any form of electrical plug having pins that extend from a body to engage in a corresponding socket, though the invention is especially useful for plugs that are intended to be carried when not in use, eg an adaptor for a laptop PC, and where it would be desirable for the pins to be moved into an inoperative position for ease of carrying so that the pins do not damage other items or hurt a user's hand in any accident.

Figure 3:
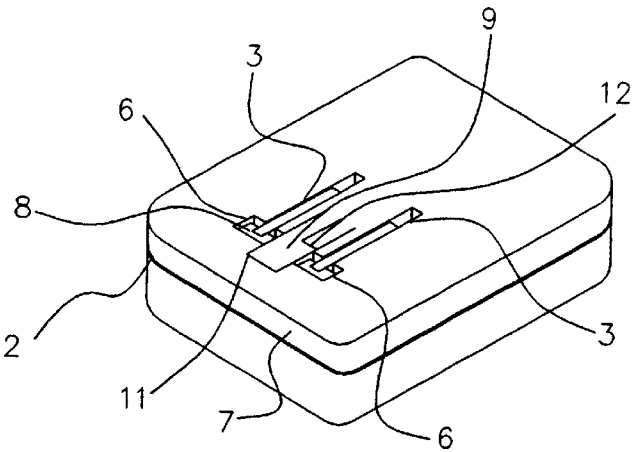

Considering firstly FIG. 3 there is shown an AC adaptor comprising a generally rectangular adaptor body 2. Within the adaptor body 2, which may conventionally be formed of plastics materials, is received the adaptor circuitry, for example for adapting a mains supply to the requirements of a particular piece of electrical apparatus. In a top surface of the adaptor body 2 are formed two elongate parallel slots 3 adapted to receive the pins 1 when not required. The slots extend parallel to the long axis of the rectangular adaptor body 2 and have enlarged ends 6 located adjacent a shorter edge 7 of the adaptor body 2. Within each enlarged slot end 6 is received a pivot body 8 formed at an end of each pin 1 as will be described in more detail further below.

Figure 4:
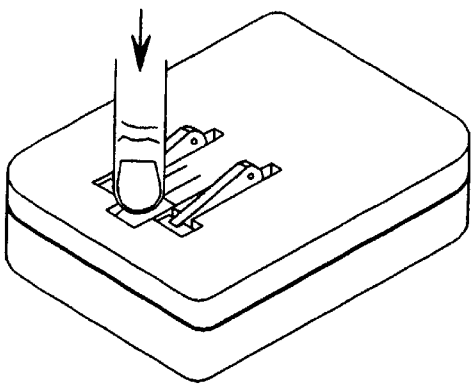
Figure 6:
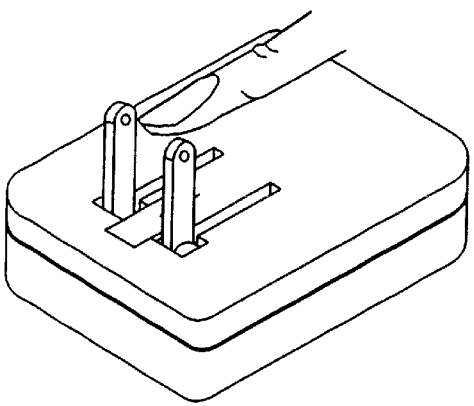
Figure 5:
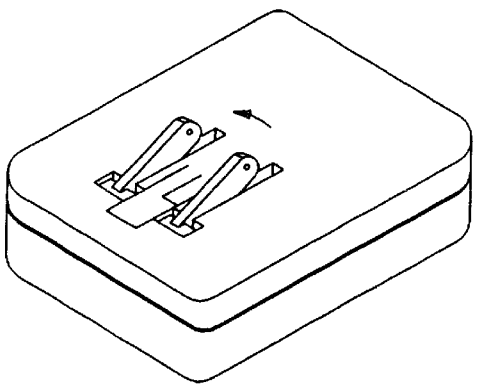
Figure 7:
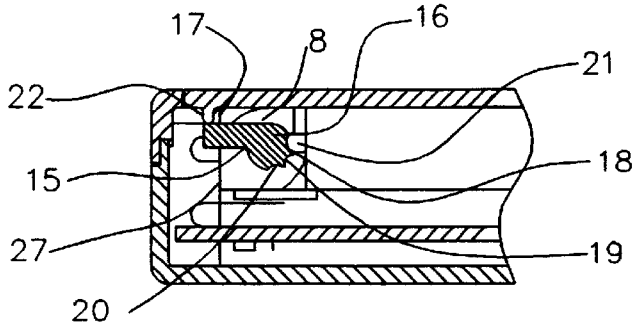

Located in the top surface of the adaptor body 2 between the slots 3 is a tongue 9 formed by cuts 11,12 in the top surface. In operation of the adaptor in order to move the pins 3 from their non-operative position shown in FIG. 3 to the operative position shown in FIG. 6, a user firstly presses on the tongue 9 with his or her finger as shown in FIG. 4 and this causes the pins 1 to be raised slightly above the surface of the adaptor as shown in FIG. 5. From this position a user's fingers may be employed to complete the pivotal motion of the pins 1 into their operative position as shown in FIG. 6. FIGS. 7 to 10 explain how this pivotal motion of the pins 1 is effected. As mentioned above, at one end of each pin 1 is formed an enlarged pivot body centered on the pivot axis 14 of the pins 1. Fixed to this pivot body 8 is a locking member 15. A single locking member 15 is formed between and connected to the two pivot bodies 8 so that the pair of pins 1 form a single member that can pivot as one.

Locking member 15 has a first portion 16 centered on the pivot axis 14, and a second portion 17 extending from the first portion 16. The first portion 16 is approximately circular and is formed with three locking recesses 18,19,20 disposed circumferentially about the pivot axis and which are adapted to engage a corresponding locking pawl 21 formed on the underside of the top surface of the adaptor body 2. The second portion 17 of the locking member is engaged by a downwardly projecting pin 22 formed on the underside of the tongue 9.

Figure 8:
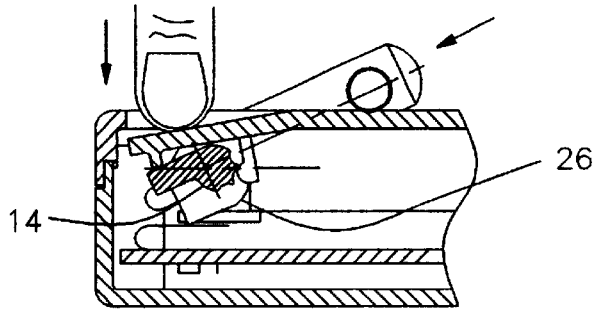
Figure 9:
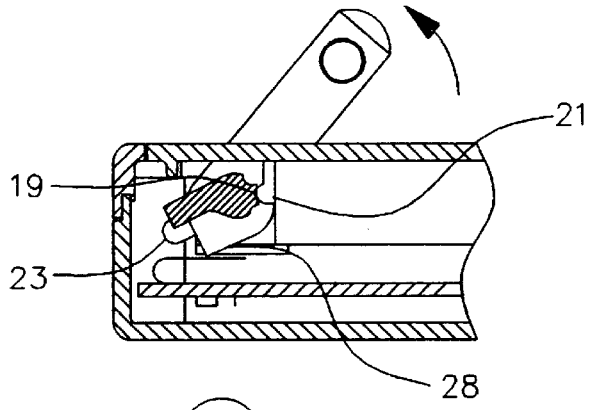

As shown in FIG. 8, when the tongue 9 is depressed by a user the pin 22 acts upon the second portion 17 of the locking member 15 and causes it to pivot slightly in an anticlockwise sense as viewed in the Figures. At the same time the depression of the tongue 9 and the consequent anticlockwise rotation causes the locking pawl 21 to slightly disengage from the first locking recess 18 so as to allow the rotation of the pins 1. Thus the pins 1 are caused to be pivoted so that they extend slightly above the top surface of the adaptor body 2. This is the position shown in FIG. 9, the locking pawl 21 engages locking recess 19 formed on locking member 15.

Figure 10:
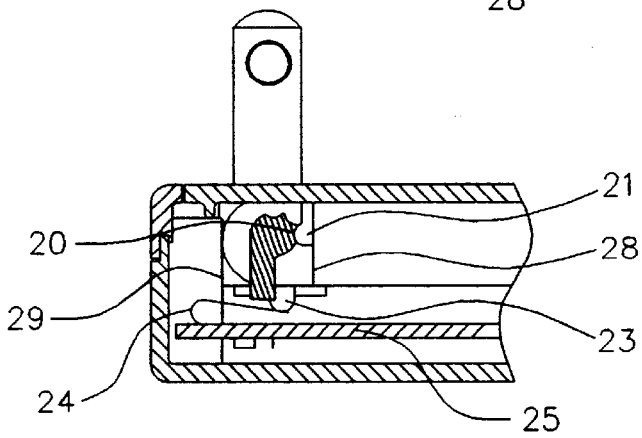
Figure 12:
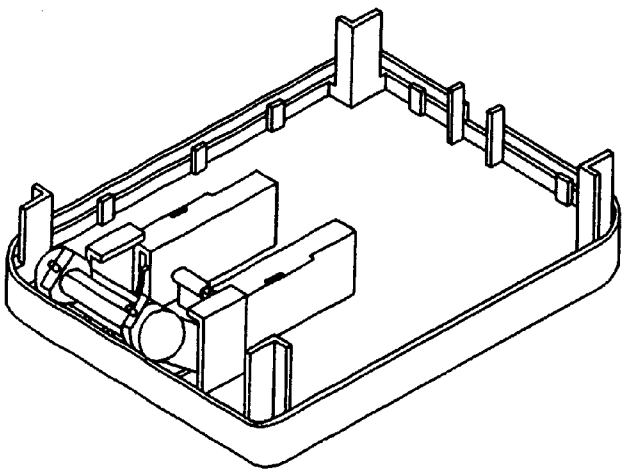

To complete the movement of the pins 1 from their non-operative position into a vertical operative position, as shown in FIG. 10, a user pushes the partially released pins 1 so as to overcome the resistance of the locking pawl 21 which is then moved into the third locking recess 20. In this position the pins 1 extend vertically from the adaptor body and are ready for use. It should also be noted that the pivot body is formed with a small projecting member 23 that projects in the opposite direction from the pins 1. As the pins 1 are pushed into their final operative position shown in FIG. 10, it will be seen that the projecting member 23 comes into contact with a spring contact 24 formed on circuit board 25 to provide the electrical contact from the pins 1 to the circuit board 25.

A further advantage of the present design is that as the locking pawl 21 moves between the recesses 18,20 a sound is generated that indicates to a user when the pawl is safely engaged in a recess.

The limits of the pivotal movement of the pins 1 are defined by flat surfaces 26, 27 formed on the pivot body 8 and which engage corresponding stops 28, 29 formed within the adaptor. In the operative position flat surface 26 engages stop 28, while in the non-operative position flat surface 27 engages stop 29. This combination of stops and flats prevents the pins from going beyond either their first or second position.

Figure 14:
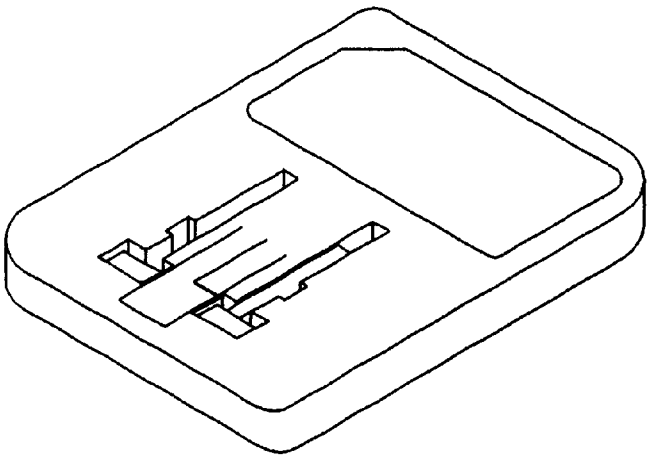

FIGS. 11 to 14 illustrate how the adaptor of FIGS. 1 to 10 may be assembled, and in particular the insertion of the pins 1 in the adaptor body 2. The adaptor body 2 is formed of two halves: top half 40 and bottom half (not shown) which holds any required circuitry. The top half 40 is shown inverted in FIGS. 11 to 13 so that one sees that inside surface of the top half 40. The external top surface of the adaptor body is the outer surface of the top half 40 as shown in FIG. 14 and includes slots 3, cuts 11, 12 as discussed above.

Figure 11:
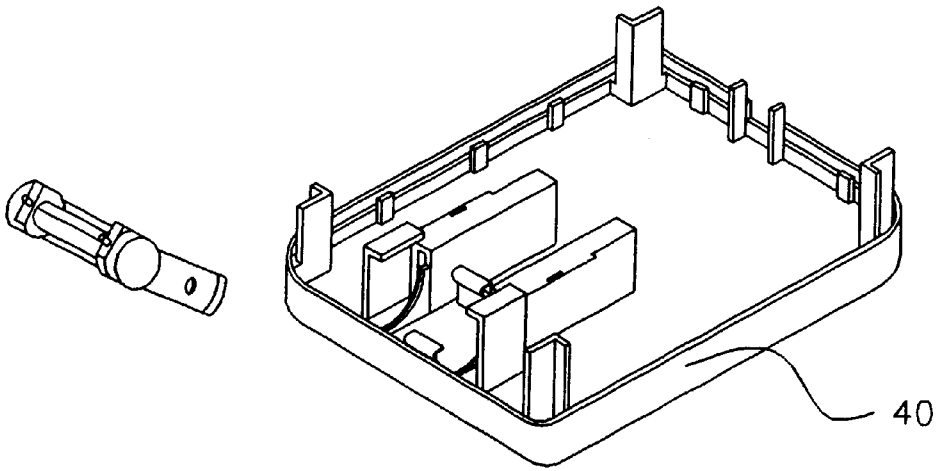
Figure 13:
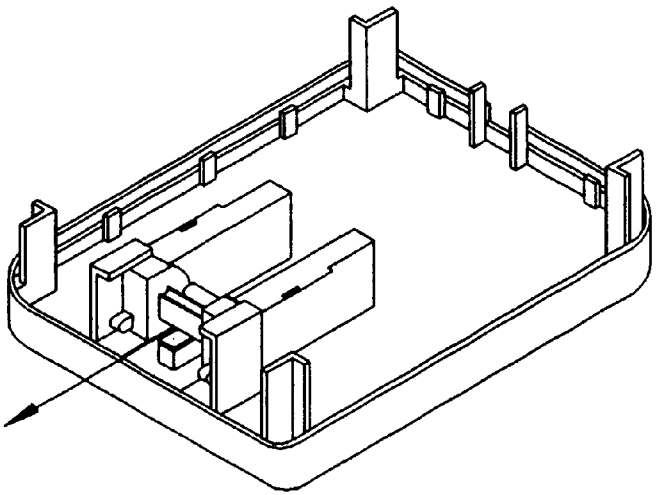

As can be seen from FIG. 11, the pins 1 are inserted from the inside through the enlarged ends 6 of the slots at an angle of approximately 45° until the pivot bodies 8 of the pins 1 are received in place. This is the position of FIG. 12. By rotating locking member 15 the pins 1 are then moved so that they are received within the slots 3 (FIG. 13). In this position the top half 40 can then be inverted to the position of FIG. 14 so that the top half 40 can be fitted to the lower half in a further operation.

It is important to note there that when the pins 1 have been inserted into the enlarged ends 6 of the slots 3 they are held in place and prevented from falling out of the top half 40 by means of housings 41 that define the slots 3 and which receive the length of the pins 1 when the pins 1 are within slots 3 and flat surfaces 26 which cover the pivot bodies 8 during the assembly operation.

It will thus be seen that the present invention, at least in its preferred forms, provides a number of advantages over the prior art. For example, when the pins are not required they are received completely within the slots leaving no exposed ends or edges that could be dangerous, especially with blade-like flat pins. The pins are caused to be released from this non-operative position by a simple pressing action on the tongue. There is therefore no need to form the adaptor body with recesses to allow a user's fingers to reach the pins to release them. The pins are caused to pivot outwardly with the pivot axis being located at the ends of the pins adjacent an edge of the adaptor body. This means that the pivot mechanism is moved from a location towards the center of the adaptor—as in the prior art—to a location near the edge of the adaptor. In this position less space is required to form a buffer clearance around the pivot mechanism and the connection between the pins and the circuitry within the adaptor.

A further advantage is that the adaptor is of a very thin low profile construction that minimizes the space required by the adaptor, both when in use and also when not in use. The adaptor is also easy to assemble, in particular in that the pins can be inserted into the top half of the body and will not fall therefrom after insertion during further assembly steps.

As mentioned above, while the above embodiment is in the context of an AC power adaptor, the present invention is not limited thereto and could be applied to any form of plug for engaging a socket. Naturally the invention is in addition not limited to just two pins, but could be applied to any number of pins.

What is claimed is:

1. An electrical plug comprising a body and at least two pins, said pins being movable between a first operative position in which the pins extend from the body, and a second non-operative position in which the pins are received within slots formed in the body, wherein said pins are pivotally mounted for movement between said first and second positions and wherein the pins pivot about a pivot axis located at an end of each respective pin adjacent an edge of the body whereby when said pins pivot from said second position to said first position, ends of said pins that are distal from said pivot axis move towards said edge of said body, and wherein when said pins are in said second position, said pins are completely received within said slots, and further including a tongue formed in a surface of said body such that depression of said tongue causes partial rotation of said pins from said second position toward said first position to an intermediate position at which said pins project above said surface.

2. The electrical plug as claimed in claim 1 wherein a projection is formed on an underside of said tongue, said projection engaging a member fixed to said pins so as to cause rotation thereof following depression of said tongue.

3. The electrical plug as claimed in claim 2 wherein said member is a locking member having three positions corresponding to said first, said second and said intermediate positions of said pins.

4. The electrical plug as claimed in claim 3 wherein said locking member has three recesses corresponding to said three locking positions, and wherein a locking pawl is formed on an underside of said surface of said body for engagement with said recesses.

5. The electrical plug as claimed in any preceding claim wherein means are provided for limiting movement of said pins such that said pins cannot move beyond said first and second positions.

6. The electrical plug as claimed in claim 5 wherein said limiting means comprises stop surfaces located within said body and which engage corresponding surfaces of a pivot body formed at an end of each said pin.

7. The electrical plug as claimed in claim 1 wherein said two pins and said two corresponding slots are parallel, each said slot having an enlarged end for receiving an enlarged pivot body formed at one end of each said pin, and further including a position locating member fixed to both said pivot bodies and located therebetween.

8. The electrical plug as claimed in claim 7 wherein said tongue is arranged such that upon depression of said tongue a projection formed on the undersurface of said tongue acts upon said member so as to cause said pins to pivot into said intermediate position.

9. A method for assembling an electrical plug having at least two pins that are movable between a first operative position in which the pins extend from a plug body, and a second inoperative position in which the pins are received within slots formed in the plug body, comprising:

(a) inserting said pins through enlarged openings formed at the ends of said slots, said pins being inserted from an inner surface of a member forming a side of said plug being formed with said slots and said pins being inserted at an angle of approximately 45° to said surface, (b) rotating said pins to that they are fully received within said slots, and (c) assembling said member to the remainder of said plug, wherein said inner surface of said member is formed with at least one surface for preventing disengagement of said pins from said member during the assembly operation.

10. The method as claimed in claim 9 wherein said at least one disengagement preventing surface comprises surfaces that define said slots.

11. The method as claimed in claim 9 wherein said at least one disengagement preventing surface comprises a stop surface formed to act on a pivot body formed at the end of one of said pins during pivoting of said pins.

* * * * *